US007665545B2

(12) United States Patent
Telfer

(10) Patent No.: US 7,665,545 B2
(45) Date of Patent: Feb. 23, 2010

(54) PRESSURE CONTROLLED DOWNHOLE OPERATIONS

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 119 days.

(21) Appl. No.: 10/558,033

(22) PCT Filed: May 27, 2004

(86) PCT No.: PCT/GB2004/002261

§ 371 (c)(1),
(2), (4) Date: Oct. 18, 2006

(87) PCT Pub. No.: WO2004/106694

PCT Pub. Date: Dec. 9, 2004

(65) Prior Publication Data

US 2007/0095573 A1 May 3, 2007

(30) Foreign Application Priority Data

May 28, 2003 (GB) ..... 0312180.3

(51) Int. Cl.
*E21B 7/00* (2006.01)

(52) U.S. Cl. ..... 175/57; 175/237; 175/268; 166/318

(58) Field of Classification Search ..... 166/373, 166/386, 318, 334.4, 319; 175/57, 268, 270, 175/276, 237
See application file for complete search history.

(56) References Cited

U.S. PATENT DOCUMENTS 2,828,107 A * 3/1958 Bobo ..... 175/69
3,105,562 A * 10/1963 Stone et al. ..... 175/268
3,414,069 A * 12/1968 Kammerer, Jr. ..... 175/268
3,433,313 A * 3/1969 Brown ..... 175/270
4,520,870 A * 6/1985 Pringle ..... 166/317
6,253,861 B1 7/2001 Carmichael et al.
6,609,569 B2 * 8/2003 Howlett et al. ..... 166/264
7,036,611 B2 5/2006 Radford et al.
2007/0107944 A1 * 5/2007 Lee ..... 175/317

FOREIGN PATENT DOCUMENTS

| | | |
|---|---|---|
| EP | 0787888 A2 | 8/1997 |
| EP | 0989284 A2 | 3/2000 |
| GB | 2341405 | 9/2002 |
| WO | WO 02/061236 A1 | 8/2002 |

OTHER PUBLICATIONS

Bill King and Robert Clayton, "Near-bit reaming tool allows continuous drilling, under-reaming", Offshore—00/04/2000 (p. 58).

* cited by examiner

*Primary Examiner*—Shane Bomar
(74) *Attorney, Agent, or Firm*—Osha • Liang LLP

(57) ABSTRACT

A method and apparatus for temporarily increasing fluid pressure at a specific location in a work string to perform an operation in an oil or gas well bore. Apparatus is provided which, in a first position provides fluid flow through the work string; in a second position provides the desired increase in fluid pressure to perform the operation in the well bore by dropping a ball (62) into the apparatus; and, by shearing pins (52) to move a sleeve (50) within the apparatus, provides a third position which returns fluid flow through the work string via bypass channels (26) created in the apparatus around the ball. Operation of a pressure activated near bit reamer in conjunction with the apparatus is also described.

28 Claims, 3 Drawing Sheets

PRESSURE CONTROLLED DOWNHOLE OPERATIONS

Figure 1:
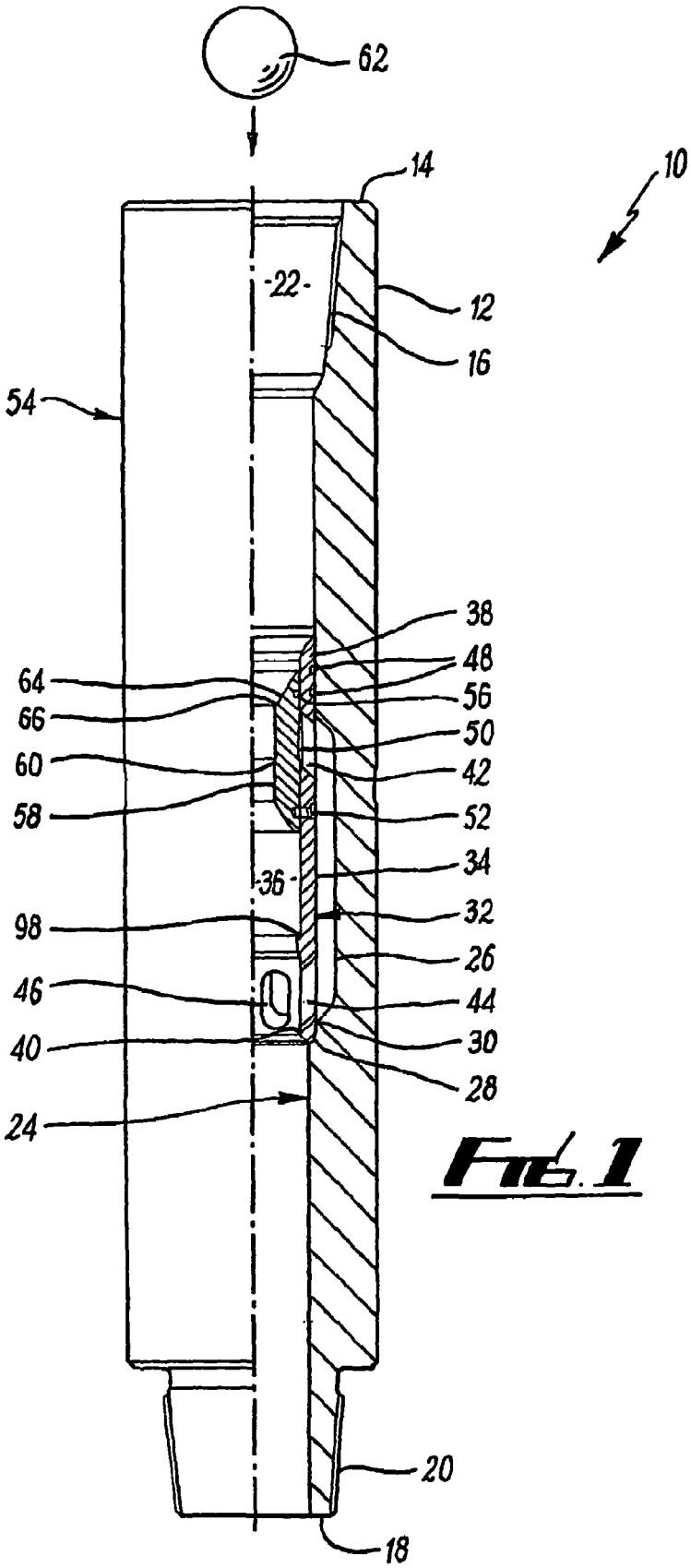

This application claims priority from PCT/GB2004/002261, having an international filing date of 27 May 2004, and a priority date of 28 May 2003.

The present invention relates to methods and apparatus used in the drilling and production of oil and gas wells and in particular, to a method and apparatus of temporarily increasing fluid pressure at a specific location in a work string to perform an operation in a well bore.

It is known that during drilling and completion operations in a well bore fluids can be pumped down the work string. In drilling operations, mud is circulated down the work string in order to cool the drill bit and assist in bringing drill cuttings back up the well bore in the annulus between the work string and the well bore wall. Further fluid can be pumped through the work string to provide a cleaning operation against walls of the well bore or a tubular located therein. Yet further, changes in fluid pressure through the work string can be used to actuate tools within the work string. This is commonly achieved by increasing the pump pressure at the surface of the well. A high pressure wave or wall is passed through the work string until it reaches the desired tool. With sufficient increase in fluid pressure, shear pins holding a shoulder of the tool within the bore of the work string can be forced to shear. The consequential movement of the shoulder operates the tool.

An example of such a tool is a pressure activated near bit reamer (NBR). On shearing pins in this tool, cutters extend radially from the tool body and are used to open up the size of the drilled hole at a desired location.

A major disadvantage of these tools is that they must run with a low activation pressure, so that the fluid flow rate in the drill string can be built up sufficiently to supply the increased pressure required to shear the shear pins. This restricts an operators ability to pump fluid i.e. drilling mud, through the drill string at an optimum rate for drilling until the tool is operated. Working close to the activation pressure can result in premature activation of the tool, with disastrous consequences to the drilling operation.

Additionally as the fluid pressure must be increased initially at the surface of the well, there is a risk that the travelling increased fluid pressure could activate other tools located higher on the work string. Further it is difficult to predict the fluid pressure at a precise location on the work string when the pressure increase is induced at the surface of the well.

It is an object of at least one embodiment of the present invention to provide a method for providing a temporary controlled increase in fluid pressure at a selected location in a work string to perform an operation in a well bore.

It is a further object of at least one embodiment of the present invention to provide a method of operating a pressure activated tool on a work string which has a high activation pressure.

It is a further object of at least one embodiment of the present invention to provide apparatus for creating a pressure barrier in a drill string to operate a pressure activated tool.

According to a first aspect of the present invention there is a method for providing a temporary controlled increase in fluid pressure at a selected location in a work string to perform an operation in a well bore, the method comprising the steps;

(a) mounting in the work string a pressure shear sub, the sub having a first position to provide fluid flow through a central bore of the work string; a second position blocking fluid flow through the bore and a third position, returning fluid flow through the sub via a bypass channel, the tool being operable from the second to the third position by a predetermined fluid pressure;

(b) running the work string into a well bore and flowing fluid through a bore at a first pressure, below the predetermined pressure;

(c) locating the pressure shear sub below the selected location in the well bore;

(d) dropping a ball into the bore to locate in the sub and cause the sub to operate in the second position;

(e) building up fluid pressure in the bore towards the predetermined fluid pressure;

(f) performing the operation in the well bore using the increased fluid pressure at the selected location; and (g) continuing to build up pressure in the bore to the predetermined fluid pressure and causing the sub to move from the second position to the third position to re-establish fluid flow through the work string.

As the pressure will build up from a constant pump pressure at the surface, there is no need to provide additional surface pumping to increase pressure at the sub. The fluid pressure to provide the operation in the well bore needs only to lie between the first pressure and the predetermined pressure. Additionally once the predetermined pressure has been reached and flow is re-established, the fluid pressure in the bore will return to the first pressure.

Preferably the method includes the step of shearing shear pins in the sub at the predetermined pressure. More preferably the method includes the step of shifting a sleeve within the sub when the shear pins are sheared.

The method may further include the step of locking the sub into the third position.

Preferably the method includes the step of bypassing the drop ball to re-establish fluid flow through the bore.

According to a second aspect of the present invention there is provided a method of operating a pressure activated tool in a drill string, the method comprising the steps;

(a) mounting in the drill string a pressure activated tool operable by a first pressure;

(b) mounting in the drill string below the pressure activated tool a pressure shear sub, the sub having a first position to provide fluid flow through a central bore; a second position blocking fluid flow through the sub and a third position, returning fluid flow through the sub via a bypass channel, the tool being operable from the second to the third position by a second pressure;

(c) running the drill string into a well bore to drill while flowing fluid through a bore of the drill string at an optimum pressure for drilling;

(d) locating the pressure activated tool at a desired location in the well bore;

(e) dropping a ball into the bore to locate in the sub and cause the sub to operate in the second position;

(f) building up pressure in the central bore to the first pressure and activating the pressure activated tool; and (g) continuing to build up pressure in the central bore to the second pressure and causing the sub to move from the second position to the third position to re-establish fluid flow through the drill string.

Thus the first pressure used to activate the pressure activated tool can be significantly greater than the optimum pressure for drilling. Additionally the optimum pressure required for drilling can be reinstated after the pressure activated tool has been operated.

The method may include the step of shearing shear pins in the pressure activated tool at the first pressure.

Preferably the method includes the step of shearing shear pins in the sub at the second pressure. More preferably the method includes the step of shifting a sleeve within the sub when the shear pins are sheared.

Preferably the method includes the step of reaming the well bore from the pressure activated tool when the tool is activated.

According to a third aspect of the present invention there is provided apparatus for providing a temporary controlled increase in fluid, pressure at a selected location in a work string, the apparatus comprising a substantially cylindrical body mounted in a work string, the body including a central bore in which is located valve means, the valve means having a through bore in which is located a ball seat and at least one port extending radially between the through bore and the body, and a ball for locating in the seat, wherein the valve means is held in a first position by one or more shear pins to provide fluid flow through the central bore; a second position blocking fluid flow through the central bore is achieved with the ball in the ball seat, and on shearing the pins, the valve means locates in a third position returning fluid flow through the central bore via one or more bypass channels created via the at least one port around the ball.

Preferably the valve means comprises a sleeve, wherein the ball seat locates on an inner surface thereof and the at least port extends through the sleeve. The sleeve may be in two parts, an inner and outer sleeve. The ball seat may be on the inner sleeve and the at least one port extends through the outer sleeve.

The sleeve may be held to the body in the first position by the shear pins. Alternatively the inner and outer sleeves may be held together by the shear pins. By locating the shear pins through the second sleeve and not the tool body, the outer surface of the tool body is smooth and clean, advantageously having no indentations, ports, screw holes or the like.

Further, the body may include a shoulder on an inner surface against which the sleeve abuts.

Preferably the apparatus includes locking means to hold the valve means in the third position. This prevents movement of the valve means under reverse circulation conditions. The locking means may comprise a sprung pin which catches in a recess in the third position.

Preferably the at least one port is a plurality of radial ports arranged circumferentially around and toward an end of the sleeve. More preferably there are a plurality of radial ports also arranged circumferentially around an opposing end of the sleeve. Thus in the third position, fluid flow can be through the ports at a first end of the sleeve into the channels and through the ports at the opposing end of the sleeve back into the central bore.

The channels may be created between the sleeve and the body. Alternatively the channels may be created between the inner and outer sleeves.

According to a fourth aspect of the present invention there is provided apparatus for selectively activating a pressure activated tool on a drill string, the apparatus comprising a substantially cylindrical body mounted in a drill string below a pressure activated tool, the body including a central bore in which is located valve means, the valve means having a through bore in which is located a ball seat and at least one port extending radially between the through bore and the body, and a ball for locating in the seat, wherein the valve means is held in a first position by one or more shear pins to provide fluid flow through the central bore; a second position is achieved with the ball in the ball seat to create a pressure barrier and thereby activate the pressure activated tool, and on shearing the pins, the valve means locates in a third position returning fluid flow through the central bore via one or more bypass channels created via the at least one port around the ball and deactivate the tool.

Preferably the valve means comprises a sleeve, wherein the ball seat locates on an inner surface thereof and the at least port extends through the sleeve. The sleeve may be in two parts, an inner and outer sleeve. The ball seat may be on the inner sleeve and the at least one port extends through the outer sleeve.

The sleeve may be held to the body in the first position by the shear pins. Alternatively the inner and outer sleeves may be held together by the shear pins. By locating the shear pins through the second sleeve and not the tool body, the outer surface of the tool body is smooth and clean, advantageously having no indentations, ports, screw holes or the like.

Further, the body may include a shoulder on an inner surface against which the sleeve abuts.

Preferably the apparatus includes locking means to hold the valve means in the third position. This prevents movement of the valve means under reverse circulation conditions. The locking means may comprise a sprung pin which catches in a recess in the third position.

Preferably the at least one port is a plurality of radial ports arranged circumferentially around and toward an end of the sleeve. More preferably there are a plurality of radial ports also arranged circumferentially around an opposing end of the sleeve. Thus in the third position, fluid flow can be through the ports at a first end of the sleeve into the channels and through the ports at the opposing end of the sleeve back into the central bore.

The channels may be created between the sleeve and the body. Alternatively the channels may be created between the inner and outer sleeves.

Preferably the pressure activated tool is a near bit reamer as is known in the art.

Embodiments of the present invention will now be described, by way of example only, with reference to the following Figures of which:

FIG. 1 is a part cross-sectional view through a pressure shear sub according to an embodiment of the present invention.

Figure 2A:
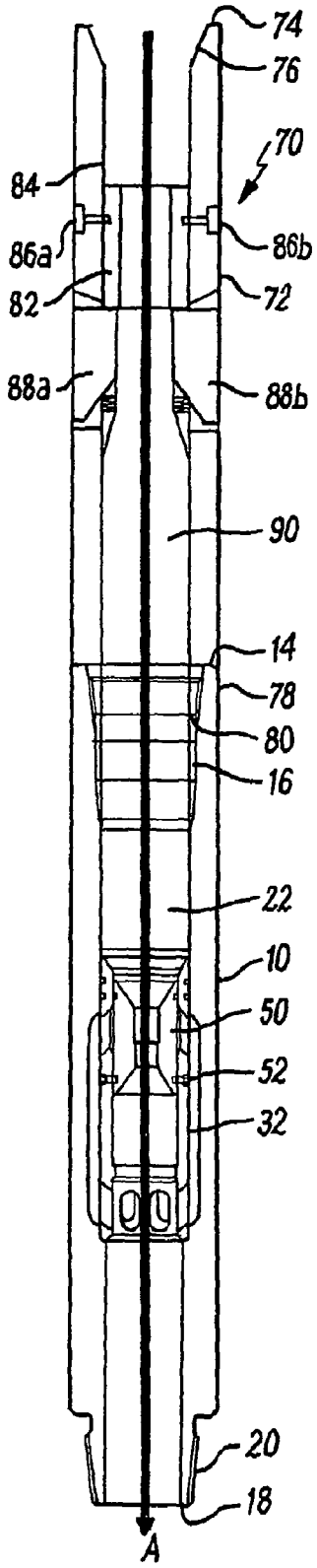
Figure 2B:
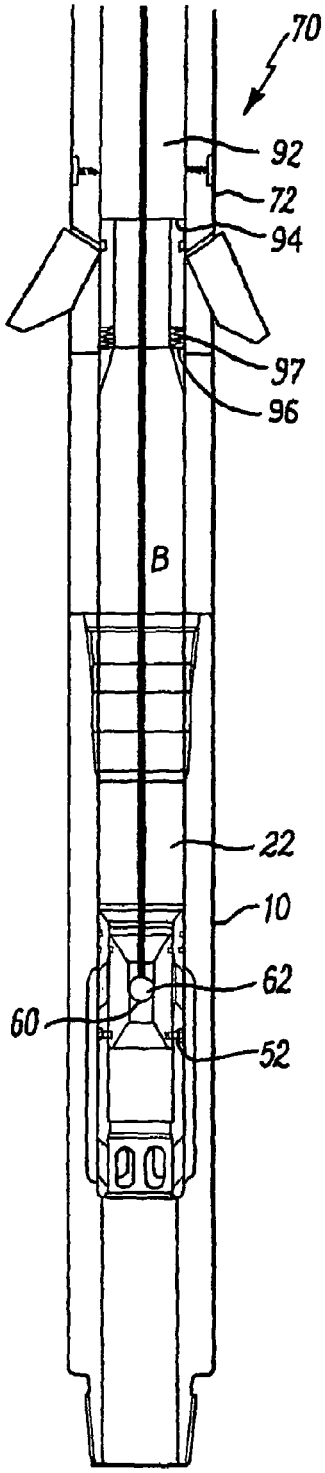
Figure 2C:
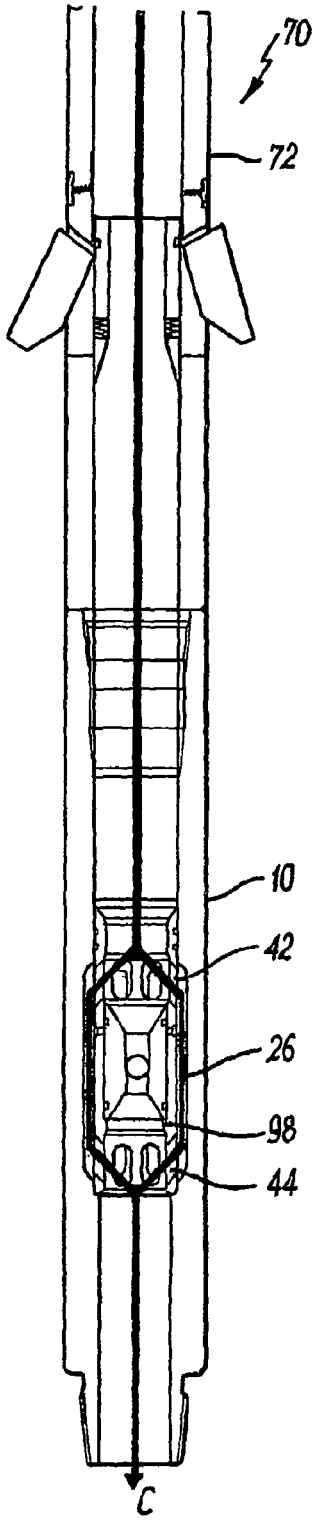
Figure 3:
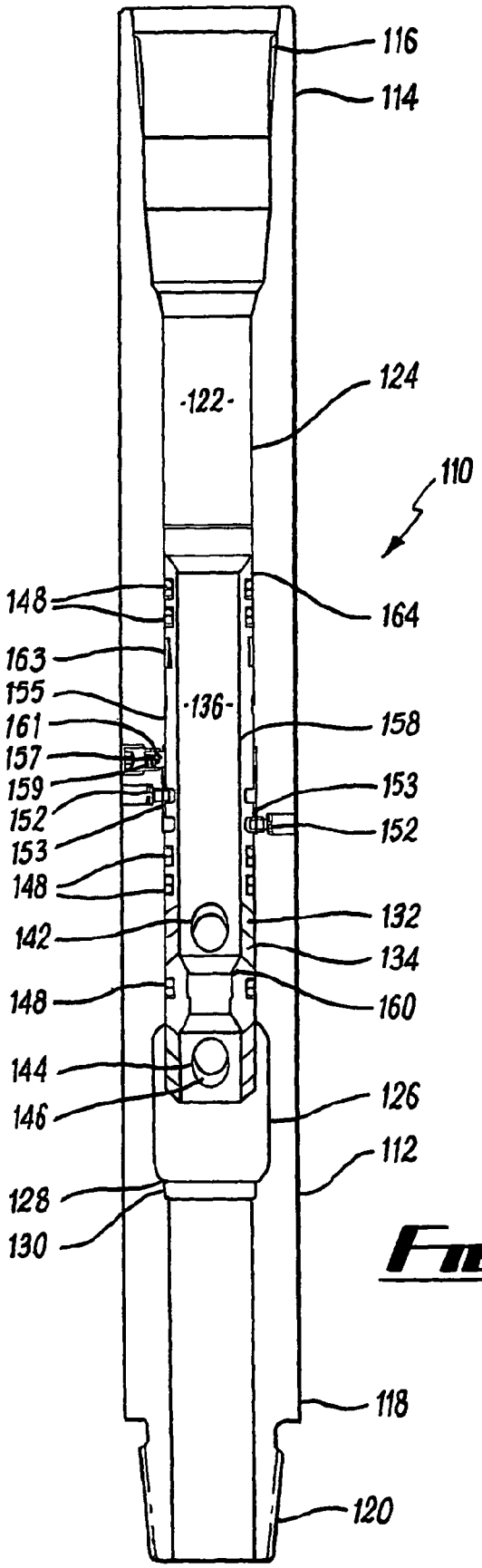

FIGS. 2(*a*), (*b*), and (*c*) are cross-sectional views through a portion of a drill string, illustrating a method of activating a pressure activated tool in a drill string according to a second embodiment of the present invention; and FIG. 3 is a cross-sectional view through a pressure shear sub according to a third embodiment of the present invention.

Reference is initially made to FIG. 1 of the drawings which illustrates a sub, generally indicated by reference numeral 10, in accordance with an embodiment of the present invention. Sub 10 comprises a tubular body 12 having at an upper end 14 a box section 16 and at a lower end 18 a pin section 20. Sections 16, 20 allow for the sub to be mounted in a work string such as a drill string. Body 12 includes a central bore 22 running axially from the upper end 14 to the lower end 18 to allow for the passage of fluid through the sub 10.

On an inner surface 24 of the body 12 is located a channel 26 formed by removing a longitudinal section of the body 12 in the form of a recess. Channel 26 is arranged circumferentially around the inner surface 24 of the body 12.

Additionally a lip or shoulder 28 is created at a lower end 30 of the channel 26.

Located against the stop 28 is a first sleeve 32. Sleeve 32 is a cylindrical body 34 having a through bore 36 which is coaxial with the central bore 22 of the body 12. Arranged at an upper end 38 and a lower end 40 of the sleeve 32 are radial ports 42, 44. Each set of radial ports 42, 44 comprise six apertures 46 arranged equidistantly around the sleeve 32. Further seals 48, in the form of o-rings are located between the sleeve 32 and the body 12 to prevent fluid flow between their respective surfaces.

A second sleeve 50 is located inside the first sleeve 32. Sleeve 50 is initially held to sleeve 32 by virtue of shear pin 52. Note that shear pin 52 does not require to be located through the body 12, thus ensuring the outer surface 54 of the sub 10 is free of any discontinuities. The sleeve 50 is initially located across the radial ports 42 at an upper end 38 of the sleeve 32. Seal 56 is also provided as an o-ring between each of the sleeves 32, 50 to prevent fluid flow between their respective surfaces. On an inner surface 58 of the sleeve 50 is located a ball seat 60. Ball seat 60 is as known in the art providing a circumferential ledge against which a ball 62 will rest and be unable to pass. At an upper end 64 of the sleeve 50 is arranged a funnel or conical surface used to direct the ball 62 into the ball seat 60.

Sub 10 can be easily assembled by first connecting inner sleeve 50 into outer sleeve 32 and affixing with the shear screw 52. The pressure rating of the shear screw 52 can be selected depending on the desired fluid pressure increase required at the sub 10. The two sleeves 32, 50 are then slid into the upper end 14 of the sub 10 and dropped through the bore 22 until they come to rest on the shoulder 28. The sub 10 is then ready for use.

One use of the sub 10 is as illustrated with reference to FIG. 2 which shows three steps, referenced by the FIGS. 2(*a*), 2(*b*) and 2(*c*) respectively, in the activation of a pressure activated tool on a drill string. Like reference numerals to those of FIG. 1 have been applied to aid clarity.

Initially referring to FIG. 2(*a*), there is illustrated a portion of a drill string, generally indicated by reference numeral 70, according to an embodiment of the present invention. Portion 70 comprises two tools, a sub 10 as described hereinbefore with reference to FIG. 1 and a near bit reamer 72. It will be appreciated that although a near bit reamer has been selected to show a pressure operated tool, this is the preferred embodiment, and any pressure operated tool could be inserted in the drill string. Additionally the sub 10 can be used without the presence of a pressure operated tool. Such an arrangement would provide a controlled temporary increase in pressure at the sub which could be used to, say, remove scale and provide integrity testing of the work string and tools located thereon.

An upper end 74 of the reamer 72 is connected to a drill string (not shown) using a box section 76. A lower end 78 of the reamer 72 is connected to the upper end 14 of the sub 10 by threading the box section 16 of the sub 10 to a pin section 80 of the reamer 72. The lower end 18 is connected to a lower portion of a drill string (not shown) using the pin section 20. Preferably a drill bit is located on pin section 20 so that the reamer 72 is positioned relatively close to the drill bit.

When run in the well bore, sleeve 50 of sub 10 is held to sleeve 32 and a clear bore is provided through the sub 10. Likewise, sleeve 82 of reamer 72 is held against the body 84 by shear pins 86*a,b* located through the body 84. Cutters 88*a,b* are folded into the body 84. The portion 70 can be rotated as the drill bit creates a bore hole. Drilling mud can be passed down the throughbore 90 to the drill bit following the path of arrow A. The drilling mud can be pumped at an optimum rate for drilling as the shear pins 52, 86 will be rated higher than the pressure of the flow. In particular, they are rated at a high enough level to prevent the possibility of premature activation of either tool 10, 72 by the unexpected shearing of the pins 52, 86 respectively. Additionally the shear pin 52 is rated higher than the pins 86*a,b* so that they are actuated first, as will be described hereinafter.

Reference is now made to FIG. 2(*b*) which illustrates a further step in the method. When the reamer 72 is located at a desired position for reaming to begin, the drop ball is released from the surface into the drill string. The ball 62 is carried in the fluid flow, through the bore 92 of the reamer 72 and into the bore 22 of the sub 10. The ball 62 is funnelled into the ball seat 60 of the inner sleeve 50. The ball, now arrested, prevents fluid flow through the bore 90 of the portion 70 to the drill bit, as illustrated by arrow B in the Figure. Pressure will build up in the fluid above the ball 62. A pressure differential will be created across the surface 94 of sleeve 82 in the reamer 72. When this differential pressure reaches the pressure rating of the shear pins 86*a,b*, they will shear. Consequently, the sleeve 82 moves through the bore 92 until it rests on stops 96 against springs 97. As the sleeve 82 moves it forces the cutters 88 radially outwards from the body 84. The reamer 72 is now activated and reaming can begin.

Meanwhile, pressure will be increasing on the ball 62 and consequently on the sleeve 50. When the pressure on the sleeve 50 reaches the pressure rating of the shear pin 52, this shear pin 52 shears. On shearing, sleeve 50 travels through the bore 22 until it comes to rest at stop 98 on sleeve 32. This is illustrated in FIG. 2(*c*). On moving the sleeve 50 the apertures 46 of the ports 42, 44 are now arranged across the channel 26. This provides a passage for fluid flow through the portion 70 by being able to bypass the ball 62 in the sleeve 50. The bypass is shown by arrow C, wherein fluid flows through the bore 92 of the reamer 72. It enters the bore 22 of the sub 10 and is redirected through the ports 42 into the channel 26. From the channel 26 it is directed back into the bore 22 at the lower end 18 of the sub 10 for delivering to the drill string below. The fluid pressure is sufficient to keep the reamer 72 activated.

To deactivate the reamer 72 the pressure of the fluid through the drill string is dropped. The pressure differential across the surface 94 reduces to a point where the springs 97 can move the sleeve 82 back up the reamer and allow the cutters 88*a,b* to retract back into the body 84.

Thus this provides an apparatus and method for selectively operating a pressure activated tool in a drill string, when the fluid flow in the string is set at a flow rate for optimal drilling.

Reference is now made to FIG. 3 of the drawings which illustrates an alternative embodiment of a pressure shear sub for temporarily increasing fluid pressure in a work string. Like parts to those of the sub 10 of FIG. 1 have been given the same reference numeral but with the addition of 100.

Sub 110 comprises a tubular body 120 having at an upper end 114 a box section 116 and at a lower end 118 a pin section 120. Sections 116, 120 allow for the sub to be mounted in a work string such as a drill string. Body 112 includes a central bore 122 running axially from the upper end 114 to the lower end 118 to allow for the passage of fluid through the sub 110.

On an inner surface 124 of the body 112 is located a channel 126 formed by removing a longitudinal section of the body 112 in the form of a recess. Channel 126 is arranged circumferentially around the inner surface 124 of the body 112.

Additionally a lip or shoulder 128 is created at a lower end 130 of the channel 126.

In this embodiment a single part sleeve 132 is Located in the bore 122 against the inner surface 124 of the body 112. Seal 148, in the form of o-rings are located between the sleeve 132 and the body 112 to prevent fluid flow between their respective surfaces.

Sleeve 132 is a cylindrical body 134 having a through bore 136 which is coaxial with the central bore 122 of the body 112. On an inner surface 158 of the sleeve 132 is located a ball seat 160. Ball seat 160 is as known in the art providing a circumferential ledge against which a ball will rest and be unable to pass. At an upper end 164 of the sleeve 132 is arranged a funnel or conical surface used to direct the ball into the sleeve 132 and towards the ball seat 160.

Arranged above and below the ball seat 160 are radial ports 142, 144 respectively. Each set of radial ports 142, 144 comprise four apertures 146 arranged equidistantly around the sleeve 132.

Shear pins 152 are arranged through the body 112 to locate within recesses 153, circumferentially arranged around the outer surface 155 of the sleeve 132. The circumferential recesses 153 allow the sleeve 132 to rotate within the body 112 while being held in a longitudinal position in relation to the body 112.

Locking pin 157 is also arranged through the body 112. The pin 157 includes a spring 159 which urges a stop 161 out of the inner surface 124 of the body 112 into the central bore 122. A locking recess 163 being a circumferential groove, is located on the outer surface 155 of the sleeve 132 towards the upper end 164 thereof.

In use, sleeve 132 is inserted through the bore 122 and positioned such that the shear pins 152 can locate in the recesses 153. Accordingly shear pins 152 are screwed in position. The shear pins 152 are selected with a rating greater than the maximum fluid pressure required to perform the chosen operation in the well bore. With the pins 152 in place, the ball seat 160 is arranged above the channel 126 and via seals 148 around the seat 160, all fluid flow must pass through the central bore 122 and the seat 160. The stop 161 of the locking pin 157 is urged against the outer surface 155 of the sleeve 132. This is the first position and the sub 110 can be mounted on a work string using the pin 120 and box 116 sections and run into a well bore. Fluid can be pumped at any chosen rate through the work string and the sub 110.

When the sub 110 has reached the desired location in the well bore where a pressure increase is required, a drop ball is released from the well surface through the work string and into central bore 122. The ball locates in the ball seat 160. Due to the dimensions of the ball relative to the seat 160, the ball seals against the seat and fluid flow is stopped at the ball. This is the second position. With the fluid flow rate maintained from the surface of the well, fluid pressure will increase at the sub 110 due to the pressure barrier at the ball seat 160. This increased fluid pressure at the sub 110 can now be used to perform any desired task or operation in the well bore. For example the increased pressure may be used remove scale, allow an integrity test to performed in the string above the sub 110 or operate a tool as described with reference to FIG. 2.

When the pressure increase is no longer required, either pumping from the surface continues until the pressure increase reaches the shear rating of the pins 152 or pumping can be increased to reach the shear rating in a faster time. When the shear rating is reached the pins 152 shear and the sleeve 132 is forced downwards through the bore 122. The sleeve 132 will travel until it abuts the stop 128 at the base 130 of the channel 126. At this point the locking pin 157 will align with the recess 163 and the stop 161 will be urged into the recess 163. The sleeve 132 is thus fixed in this position and cannot move up or down relative to the body 112. In falling, the ball seat 160 is now located at the channel 126. The ports 142, 144 are also located in the channel 126 and thus a bypass is provided as fluid can travel out of the ports 142, through the channel 126 around the ball seat 160, and back into the central bore 122 via the ports 144. This bypass allows the fluid pressure to return to the pump pressure from the surface. This is considered as the third position.

The principal advantage of the present invention is that it provides a method and apparatus to temporarily increase fluid pressure at a selected location in a work string to perform an operation in a well bore.

A further advantage of at least one embodiment of the present invention is that it provides method and apparatus to selectively operate a pressure activated tool in a drill string. Further the tool can have a higher activation pressure than the optimum fluid pressure for drilling and this reduces the risk of the tool activating prematurely.

Modifications may be made to the invention herein described without departing from the scope thereof. For example, the number of ports and there location on the sleeve can be varied. The drop ball may be a dart or other plug which blocks the central bore through the sub. Additionally the near bit reamer could be replaced by any pressure operated tool in combination with the sub. Further the reamer described could include roller cutters or blades as an alternative to the cutters shown.

The invention claimed is:

1. A method for providing a temporary controlled increase in fluid pressure at a selected location in a work string to operate a tool in a well bore, the method comprising the steps;

(a) mounting a pressure shear sub in the work string below the tool, the shear sub comprising a tubular body and at least one valve member moveable relative to the tubular body, and the shear sub having a first configuration with the at least one valve member in a first position to provide fluid flow through a central bore of the work string;

a second configuration with the at least one valve member in said first position, wherein introduction of a ball to the at least one valve member provides for blocking fluid flow through the bore and;

a third configuration with the at least one valve member in a second position, returning fluid flow through the sub via a bypass channel, the shear sub being operable from the second to the third configuration by a predetermined fluid pressure;

(b) running the work string into a well bore and flowing fluid through a bore at a first pressure, below the predetermined pressure;

(c) locating the pressure shear sub below the selected location in the well bore;

(d) dropping the ball into the bore to locate in the shear sub and cause the shear sub to operate in the second configuration in said first position;

(e) building up fluid pressure in the bore towards an intermediate pressure that is sufficient to operate the tool and is less than the predetermined fluid pressure;

(f) operating the tool by using the intermediate fluid pressure at the selected location; and (g) continuing to build up pressure in the bore to the predetermined fluid pressure and causing said at least one valve member to move relative to the tubular body from the first position to the second position to configure the shear sub in the third configuration and re-establish fluid flow through the work string.

2. The method as claimed in claim 1, including the step of shearing shear pins in the sub at the predetermined pressure.

3. The method as claimed in claim 2, including the step of shifting a sleeve within the sub when the shear pins are sheared.

4. The method as claimed in claim 1, including the step of locking the sub into the third position.

5. The method as claimed in claim 1, including the step of bypassing the drop ball to re-establish fluid flow through the bore.

6. A method of operating a pressure operated tool in a drill string, the method comprising the steps of:

(a) mounting in the drill string the pressure operated tool operable by a first pressure;

(b) disposing in the drill string below the pressure activated tool a pressure shear sub, the sub comprising a tubular body and at least one valve member moveable relative to the tubular body and providing differing sub configurations comprising a first position, in which fluid flow is provided through a central bore, a second position associated with a ball introduced to the valve member for blocking fluid flow through the sub and a third position returning fluid flow through the sub via a bypass channel, the at least one valve member being operable from the second to the third position by a second pressure;

(c) running the drill string into a well bore to drill while flowing fluid through a bore of the drill string at an optimum pressure for drilling;

(d) locating the pressure activated tool at a desired location in the well bore;

(e) dropping the ball into the bore to locate in the sub and cause the sub to operate in the second position;

(f) building up pressure in the central bore to the first pressure;

(g) operating the pressure activated tool by using the first pressure;

(h) continuing to build up pressure in the central bore to the second pressure and causing the at least one valve member to move from the second position to the third position to re-establish fluid flow through the drill string.

7. The method as claimed in claim 6 including the step of shearing shear pins in the pressure operated tool at the first pressure.

8. The method as claimed in claim 6 including the step of shearing shear pins in the sub at the second pressure.

9. The method as claimed in claim 8 including the step of shifting a sleeve within the sub when the shear pins are sheared.

10. The method as claimed in claim 6 including the step of reaming the well bore from the pressure operated tool when the tool is activated.

11. An apparatus for selectively activating a pressure operated tool on a drill string, the apparatus comprising a sub having a substantially cylindrical body mounted in a drill string below a pressure operated tool, the body including a central bore in which is located valve means, the valve means having a through bore in which is located a ball seat and at least one port extending radially between the through bore and the body, and a ball for locating in the seat, wherein:

the valve means is held in a first position by one or more shear pins to provide fluid flow through the central bore;

a second position is achieved with the ball in the ball seat to create a pressure barrier and thereby activate the pressure operated tool; and on shearing the pins, the valve means locates in a third position returning fluid flow through the central bore via one or more bypass channels created via the at least one port around the ball;

wherein, in the third position, a flowpath through the drill string to the tool is provided for selective operation and de-activation of the tool.

12. The apparatus as claimed in claim 11 wherein the valve means comprises a sleeve, the ball seat locates on an inner surface of the sleeve and the at least one port extends through the sleeve.

13. The apparatus as claimed in claim 12 wherein the sleeve is in two parts, an inner and an outer sleeve.

14. The apparatus as claimed in claim 13 wherein the ball seat is on the inner sleeve and the at least one port extends through the outer sleeve.

15. The apparatus as claimed in claim 14 wherein the inner and outer sleeves are held together by the shear pins.

16. The apparatus as claimed in claim 13 wherein the one or more channels are created between the inner and outer sleeves.

17. The apparatus as claimed in claim 12 wherein the sleeve is held to the body in the first position by the shear pins.

18. The apparatus as claimed in claim 11 wherein the body includes a shoulder on an inner surface against which the sleeve abuts.

19. The apparatus as claimed in claim 11 wherein the apparatus includes locking means to hold the valve means in the third position.

20. The apparatus as claimed in claim 18 wherein the locking means comprises a sprung pin which catches in a recess in the third position.

21. The apparatus as claimed in claim 11 wherein the at least one port is a plurality of radial ports arranged circumferentially around and toward an end of the sleeve.

22. The apparatus as claimed in claim 21 wherein there are a plurality of radial ports also arranged circumferentially around the sleeve on an opposite side of the ball seat.

23. The apparatus as claimed in claim 11 wherein the one or more channels are created between the sleeve and the body.

24. The apparatus as claimed in claim 11 wherein the pressure operated tool is a near bit reamer.

25. A method for providing a temporary controlled increase in fluid pressure at a selected location in a work string to activate a pressure operated tool in a well bore, the method comprising the steps of:

(a) mounting in the work string below the pressure operated tool a pressure shear sub, the shear sub comprising a tubular body and at least one valve member moveable relative to the tubular body and providing a first configuration, in which the valve member is in a position wherein fluid flow is provided though a central bore of the work string, a second configuration in which the valve member cooperates with a ball blocking fluid flow though the central bore, and a third configuration in which the valve member is moved by a predetermined fluid pressure to return fluid flow though the shear sub via a bypass channel;

(b) running the work string into a well bore and flowing fluid though a bore at a first pressure, below the predetermined pressure;

(c) locating the pressure shear sub below the selected location in the well bore;

(d) dropping a ball into the bore to cooperate with the valve member and block flow though the central bore;

(e) building up fluid pressure in the central bore towards the predetermined fluid pressure;

(f) operating the tool using the increased fluid pressure at the selected location;

(g) continuing to build up pressure in the bore to the predetermined fluid pressure and causing the valve member to move to re-establish fluid flow though the work string; and (h) with the shear sub in the third configuration, controlling the fluid pressure in the work string to selectively operate and deactivate the tool.

26. A method of operating a pressure activated tool in a drill string, the method comprising the steps of:

(a) mounting in the drill string a pressure activated tool operable by a first pressure;

(b) disposing in the drill string below the pressure activated tool a pressure shear sub, said sub comprising a tubular body and at least one valve member moveable relative to the tubular body between a first position, in which fluid flow is provided through a central bore, a second position including a ball introduced to the valve member for blocking fluid flow through the sub, and a third position, returning fluid flow through the sub via a bypass channel, the tool being operable from the second to the third position by a second pressure;

(c) running the drill string into a well bore to drill while flowing fluid through a bore of the drill string at an optimum pressure for drilling;

(d) locating the pressure activated tool at a desired location in the well bore;

(e) dropping the ball into the bore to locate in the sub and cause the sub to operate in the second position;

(f) building up pressure in the central bore to the first pressure;

(g) operating the pressure activated tool by using the first pressure;

(h) continuing to build up pressure in the central bore to the second pressure and causing the sub to move from the second position to the third position to re-establish fluid flow through the drill string; and (i) with the sub in the third position, controlling the fluid pressure in the drill string to selectively operate and deactivate the tool.

27. A work string comprising:

a pressure operated tool; and a sub for providing a temporary controlled increase in fluid pressure at a selected location in the work string, the sub being mounted in the work string below the pressure operated tool, and comprising a substantially cylindrical body including a central bore in which a valve means is located, the valve means having a through bore in which a ball seat is located, and at least one port extending radially between the through bore and the body, and a ball for locating in the seat, wherein:

the valve means is held in a first position by one or more shear pins to provide fluid flow through the central bore, the one or more shear pins configured to shear at a pressure exceeding that required to operate the tool, and is configured in the first position such that said at least one port is closed; and the ball, when positioned in the valve seat, provides for blocking fluid flow through the central bore to realize said temporary controlled increase in fluid pressure; and on shearing the pins, the valve means locates in a second position returning fluid flow through the central bore via one or more bypass channels created via the at least one port around the ball;

wherein, in the second position, a flowpath through the work string to the tool provides for selective operation and de-activation of the tool.

28. An apparatus for providing a temporary controlled increase in fluid pressure at a selected location in a work string equipped with a pressure activated tool, wherein the temporary increase in fluid pressure is sufficient to activate said tool at the selected location, the apparatus comprising a ball and a pressure shear sub mounted in the work string below the pressure activated tool, the pressure shear sub comprising:

a substantially cylindrical body, the body including a central bore in which is located valve means, the valve means having a through bore in which is located a ball seat and at least one port extending radially between the through bore and the body, wherein the valve means is held in a first position by one or more shear pins designed to shear at a pressure exceeding the pressure required to activate said tool, and is configured in the first position such that said at least one port is closed and the through bore is open to fluid flow; and the valve means has a second configuration in said first position that is achieved by landing the ball in the ball seat thereby blocking the throughbore to fluid flow to allow fluid pressure to increase sufficiently to activate the tool, and the valve means is movable upon shearing of the pins to a third configuration at a second position wherein said at least one port is in fluid communication via one or more bypass channels around the ball thereby returning fluid flow through the central bore.

* * * * *